US009211698B2

(12) United States Patent
Ogino et al.

(10) Patent No.: US 9,211,698 B2
(45) Date of Patent: Dec. 15, 2015

(54) CHARGE CONTROL TYPE INK JET PRINTER AND PRINTING METHOD

(71) Applicant: Hitachi Industrial Equipment Systems Co., Ltd., Chiyoda-ku, Tokyo (JP)

(72) Inventors: Masahiko Ogino, Tokyo (JP); Hiroshi Sasaki, Tokyo (JP); Takuya Otowa, Tokyo (JP); Tomoko Maejima, Tokyo (JP); Kenichi Souma, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/463,121

(22) Filed: Aug. 19, 2014

(65) Prior Publication Data

US 2015/0077477 A1 Mar. 19, 2015

(30) Foreign Application Priority Data

Sep. 13, 2013 (JP) ..... 2013-189988

(51) Int. Cl.

| | |
|---|---|
| ***B41J 2/085*** | (2006.01) |
| ***B41J 2/035*** | (2006.01) |
| ***B41J 2/02*** | (2006.01) |
| ***B41J 11/00*** | (2006.01) |
| ***B41J 2/09*** | (2006.01) |
| ***B41J 2/125*** | (2006.01) |
| ***B41J 2/185*** | (2006.01) |

(52) U.S. Cl.

CPC .. *B41J 2/035* (2013.01); *B41J 2/02* (2013.01); *B41J 2/085* (2013.01); *B41J 2/09* (2013.01); *B41J 2/125* (2013.01); *B41J 2/185* (2013.01); *B41J 11/002* (2013.01)

(58) Field of Classification Search

CPC ..... B41J 2/085; B41J 2/09; B41J 2/095; B41J 11/002

USPC ..... 347/76

See application file for complete search history.

(56) References Cited

U.S. PATENT DOCUMENTS

| | | | | |
|---|---|---|---|---|
| 5,534,904 A * | 7/1996 | Sheinman | ..... | 347/75 |
| 6,106,107 A | 8/2000 | Sheinman | | |
| 6,503,831 B2 * | 1/2003 | Speakman | ..... | 438/674 |

(Continued)

FOREIGN PATENT DOCUMENTS

| | | |
|---|---|---|
| JP | 2000-108494 A | 4/2000 |
| JP | 2003-127339 A | 5/2003 |

(Continued)

OTHER PUBLICATIONS

European Search Report dated Jan. 27, 2015 (eight (8) pages).

*Primary Examiner* — Justin Seo
*Assistant Examiner* — Michael Konczal
(74) *Attorney, Agent, or Firm* — Crowell & Moring LLP

(57) ABSTRACT

The visibility of a printing object using a photo-curable ink is improved. A charge control type ink jet printer includes a nozzle which continuously forms ink droplets, a charging electrode which charges each of the ink droplets, a deflection electrode which deflects the charged ink droplet, and a print head which discharges the deflected ink droplet to print the droplet onto a printed substrate. The print head has a UV light source. The UV light source has a focusing member which focuses UV light onto at least part of a flying path of the ink droplet between the print head and the printed substrate and onto a landed region of the printed substrate, and a light emission source.

11 Claims, 6 Drawing Sheets

(56) References Cited

U.S. PATENT DOCUMENTS

| | | | | |
|---|---|---|---|---|
| 6,739,716 | B2 * | 5/2004 | Richards | 347/102 |
| 6,783,227 | B2 * | 8/2004 | Suzuki | B41J 11/002 347/101 |
| 7,132,159 | B1 * | 11/2006 | Akhave et al. | 428/343 |
| 7,222,952 | B2 * | 5/2007 | Uejima | 347/100 |
| 7,264,346 | B2 * | 9/2007 | Nishino | B41J 11/002 347/100 |
| 7,393,095 | B2 * | 7/2008 | Oshima | B41J 11/002 347/101 |
| 7,963,647 | B2 * | 6/2011 | Nakata | B41J 11/002 347/102 |
| 2002/0024544 | A1 * | 2/2002 | Codos | 347/8 |
| 2005/0117211 | A1 * | 6/2005 | Cotterill | 359/442 |
| 2006/0192829 | A1 * | 8/2006 | Mills et al. | 347/102 |
| 2010/0066791 | A1 | 3/2010 | Jeremic et al. | |
| 2010/0134569 | A1 * | 6/2010 | Rohlfing | 347/76 |

FOREIGN PATENT DOCUMENTS

| | | | |
|---|---|---|---|
| JP | 2010-511529 | A | 4/2010 |
| JP | 2010-260203 | A | 11/2010 |
| WO | WO 97/42034 | A1 | 11/1997 |

* cited by examiner

CHARGE CONTROL TYPE INK JET PRINTER AND PRINTING METHOD

TECHNICAL FIELD

The present invention relates to a charge control type ink jet printer and a printing method using a photo-curable ink cured by emitting light such as UV light.

BACKGROUND ART

An ink jet recording system can be classified into a charge control type and an on-demand type. In the charge control type, an ink conveyed to a nozzle by a pump is vibrated by an ultrasonic vibrator, and is then continuously pushed out to be very small droplets. The charge control type can thus continuously push out a quick-drying ink. In addition, over several tens of thousands of ink droplets per second which can be generated by ultrasonic vibration can be printed at high speed, which can be used as an industrial marker.

Examples of inks used for the ink jet printer include a solvent ink which is made by dissolving a resin and a dye or a pigment into a quick-drying organic solvent, and a photo-curable ink which is cross-linked by emitting UV light after recording. In particular, as compared with the solvent ink, the photo-curable ink has solvent resistance for a printing object, and has a low ink volatile content.

The ink jet printer using the photo-curable ink is described in e.g., Japanese Unexamined Patent Application Publication (Translation of PCT Application) No. 2010-511529. Japanese Unexamined Patent Application Publication (Translation of PCT Application) No. 2010-511529 discloses the ink jet printer having a preliminary curing apparatus and a main curing apparatus emitting radiation to the downstream of the conveying path of an ink jet printing station having a print head.

SUMMARY OF INVENTION

However, to maintain the photo-curable ink at low viscosity which can be discharged from the head, it is necessary to use a large amount of monomer content with low viscosity having a functional group for photo-curing. As a result, unlike the typical solvent ink, the photo-curable ink which is landed onto a printed surface is unlikely to be increased in viscosity unless UV light is emitted. When, like Japanese Unexamined Patent Application Publication (Translation of PCT Application) No. 2010-511529, it takes time to start UV light emission after ink landing, bleeding occurs by the time a printing object reaches the area of the UV lamp, resulting in lowered visibility.

An object of the present invention is to improve the visibility of a printing object using a photo-curable ink.

The above object can be achieved by the inventions described in the claims.

According to the present invention, the visibility of the printing object using the photo-curable ink can be improved.

DESCRIPTION OF PREFERRED EMBODIMENTS

Figure 1:
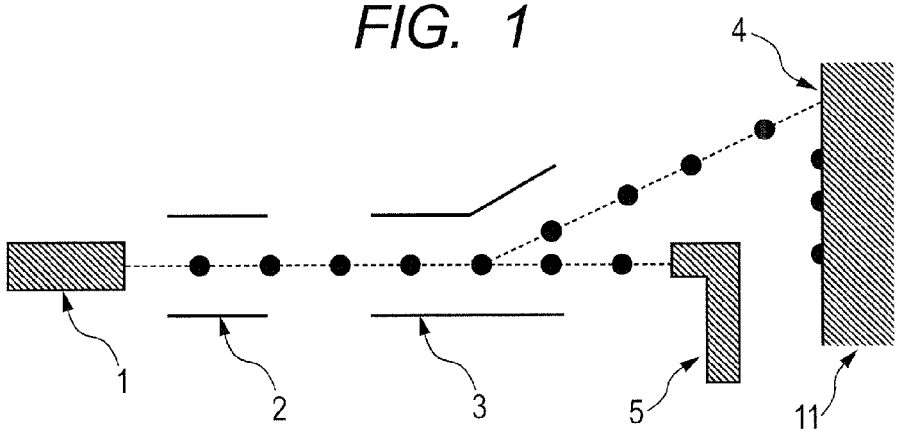
FIG. 1 is a schematic diagram of a charge control type ink jet printer.

FIG. 1 shows a schematic diagram of a charge control type ink jet printer of this embodiment. In the charge control type, an ink conveyed to a nozzle by a pump is vibrated by an ultrasonic vibrator, and is then continuously pushed out to be very small droplets. A charging electrode 2 applies predetermined charge to each of the ink droplets from a nozzle 1. The ink droplet is deflected in its trajectory by a deflection electrode 3, and then reaches a printed surface 4 of a printed substrate 11. The remaining non-charged ink droplets which have not been deflected by the deflection electrode are sucked into a collection opening called a gutter 5, and are then returned into an ink tank for re-use.

Figure 2:
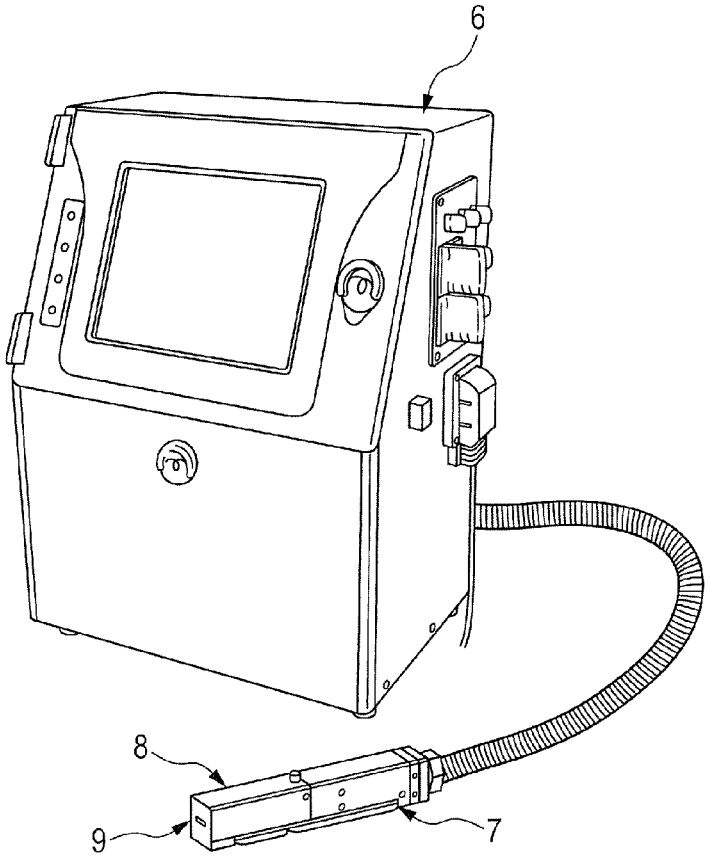
FIG. 2 is an overall perspective view of the ink jet printer.

FIG. 2 is a perspective view showing the overall configuration of the ink jet printer of this embodiment. The ink jet recording apparatus is broadly divided into a main body 6 and a print head 7. A print head cover 8 is mounted on the print head 7. The maintenance of the print head is carried out by removing the print head cover 8. During normal use, the print head cover 8 remains mounted. For printing, an ink particle passes through an opening 9 provided on the print head cover 8 to reach the fast-moving printed substrate 11, thereby printing a character.

Hereinafter, embodiments of the present invention will be described with reference to the drawings.

First Embodiment

Figure 3:
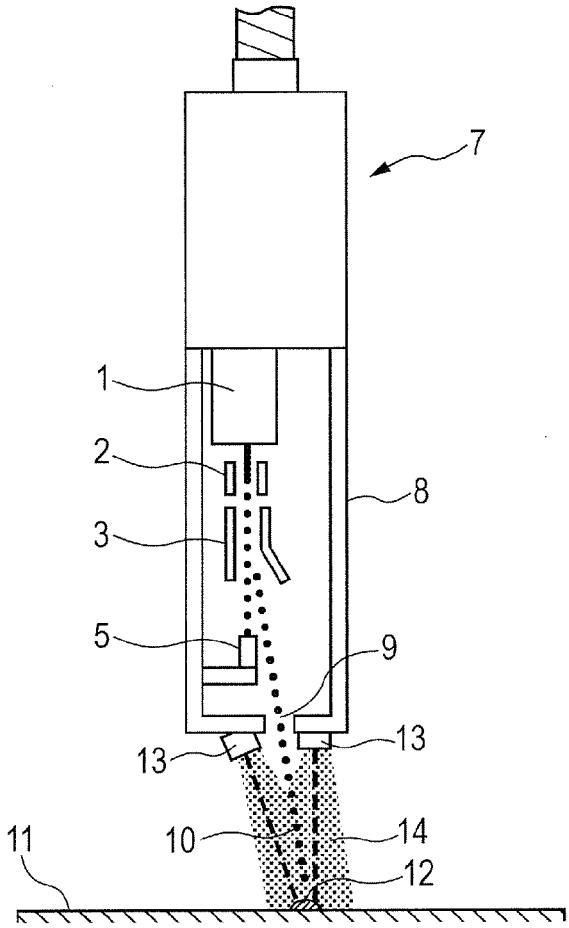
FIG. 3 is a part sectional, schematic view of a print head.

FIG. 3 is a part sectional, schematic view of the print head 7 of this embodiment. The print head has therein the nozzle 1 forming the ink into particles and jetting the ink particles, the charging electrode 2 for applying a charging voltage as a character signal to each of the ink particles, the deflection electrode 3 for deflecting the charged ink particle by an electric field, and the gutter 5 for collecting the remaining ink particles not used for printing. The ink particle passes through the opening 9 provided on the print head cover 8 and a flying path 10 to be discharged to the outside of the print head 7, and is landed onto the printed substrate 11 to form a print dot (printing object) 12.

In the ink jet printer of this embodiment, the print head 7 is provided with a UV light source 13 emitting VU light to the ink discharged from the nozzle 1, which has not been landed onto the printed substrate 11, that is, which is flying. With this, the ink starts to be gradually cured before landing, and can be easily cured at the time of landing. In addition, the UV light is emitted along the flying path to be focused thereonto. Thus, the UV light is not emitted in the useless direction outside the flying path. Further, the UV light which is likely to be scattered as it moves far from the light source is emitted to be focused onto a printed position (a region including several landed points), which can be increased in light intensity per unit area for enabling efficient emission to the ink and can instantly cure the ink after landing. Therefore, even the photo-curable ink having a low solvent content can be reduced in bleeding after landing to improve the visibility. Furthermore, the UV light is emitted to each ink droplet to be landed. It is thus unnecessary to use a very large emission device.

Figure 4:
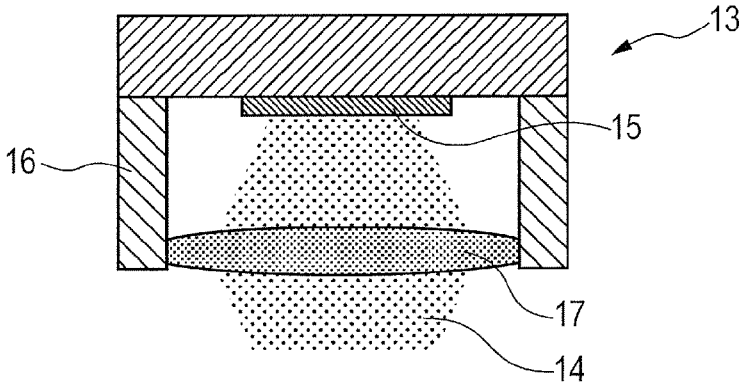
FIG. 4 is a sectional schematic diagram showing an example of a UV light source.

FIG. 4 shows a sectional schematic diagram showing an example of the UV light source 13. The UV light source 13 has a light emission source 15, a focal point adjusting mechanism 16, and a focusing mechanism 17. The light emission source 15 is not particularly limited as long as it is an element emitting the UV light. Specifically, a LED and a semiconductor laser can be used. The wavelength is not particularly limited as long as it is about 250 to 400 nm and can absorb a photoreaction initiator in the ink. In addition, the UV light having a wavelength of 350 nm or less which can modify the surface of the printed substrate can be preferably used.

The focusing mechanism 17 is not particularly limited as long as it can refract UV light 14 emitted from the light emission source 15 and can focus it onto the printed substrate. Specifically, a quartz lens can be used. The material of the focusing mechanism which does not absorb the UV light emitted from the light emission source is preferable. The ink which contains an organic solvent preferably has solvent resistance.

The focal point adjusting mechanism 16 is not particularly limited as long as it can adjust the distance between the light emission source 15 and the focusing mechanism 17 and can focus the UV light onto an ink-landed position vicinity on the printed substrate. Specifically, the focal point adjusting mechanism 16 which combines male and female threads to change the distance between the light emission source and the focusing mechanism by rotation can be used. Without the focal point adjusting mechanism 16, only the focusing mechanism 17 may be adjusted to focus the UV light. However, the changing of the distance between the light emission source and the focusing mechanism by the focal point adjusting mechanism without changing the focusing mechanism can easily adjust the focal point to facilitate focusing.

Figure 5:
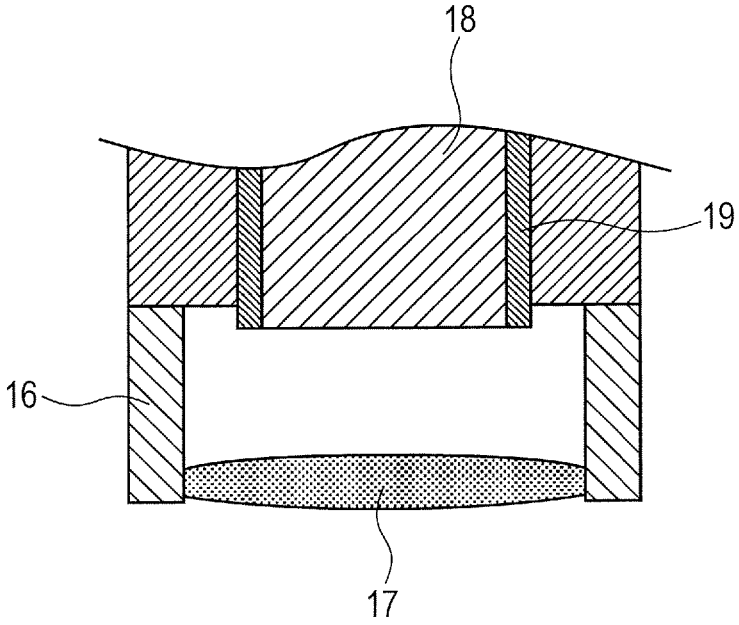
FIG. 5 is a sectional schematic diagram showing an example of a UV light source.
Figure 6:
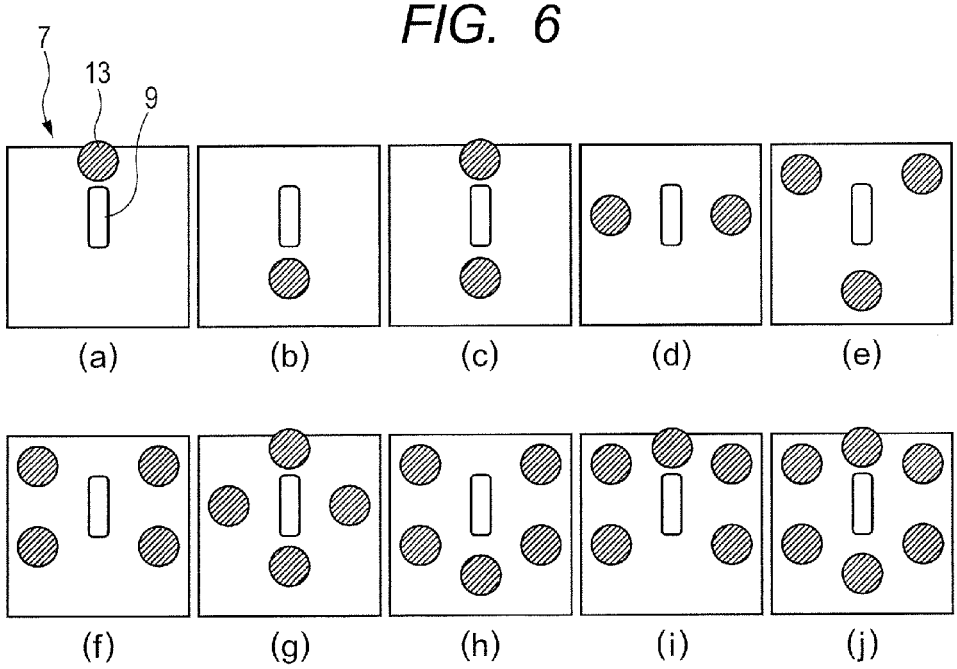
FIGS. 6A to 6J are diagrams showing the arranging examples of each UV light source at the end of the head.

FIG. 5 shows an example of another UV light source. The UV light source which employs, as the light emission source, an optical fiber having a core 18 coated with a cladding layer 19 differing in refractivity and guides the UV light from a light source, not shown, can be used. As the light source, not shown, a low-pressure mercury lamp, a high-pressure mercury lamp, an ultrahigh-pressure mercury lamp, a metal halide lamp, a gallium lamp, a xenon lamp, and a carbon arc lamp can be used. Preferably, the material of the core absorbs less of the UV light guided, and hardly causes lowering of the light intensity.

The ink is not particularly limited as long as it is polymerized and cured by UV light emission. Specifically, the ink includes a radical polymerization material, a cation polymerization material, an anion polymerization material, and a composite material of these. The composition of the ink has essential components of a chemical substance, a coloring agent, and a photoreaction initiator having a reactive functional group, and in addition to these, a solvent and an additive. The photoreaction initiator having high UV light absorption efficiency can be preferably used.

FIGS. 6A to 6J show the arranging examples of each UV light source 13 at the end of the head. FIGS. 6A to 6J show ten patterns, but the present invention is not limited to these. FIGS. 6A to 6J show outer surface views of the print head 7 seen from the opening 9 side. The opening is not required to be rectangular. When each of the UV light sources is arranged around the opening and is then adjusted to emit the UV light focused onto the flying path and the landed position vicinity of the ink discharged from the opening, its position can be appropriately adjusted according to the position of the opening and the shape of the head. Plural UV light sources each having a wavelength curing the ink or a wavelength for modifying the printed substrate can be mixedly arranged. By modifying the printed substrate, the degree of contact of the printing object can be increased to improve the visibility. In addition, plural light emission sources each having a LED or an optical fiber may be mixedly arranged.

Figure 7:
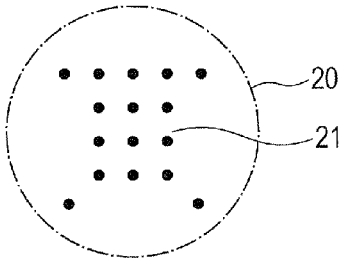
FIG. 7 shows an example of a landed position vicinity.

FIG. 7 shows an example of the landed position vicinity. FIG. 7 is a top view of the printed substrate seen from the head side, in which the position to cover printing objects 21 is a landed position vicinity 20. The UV light is preferably focused onto the inside of the substantial printing objects 21 region at maximum light intensity.

Figure 8:
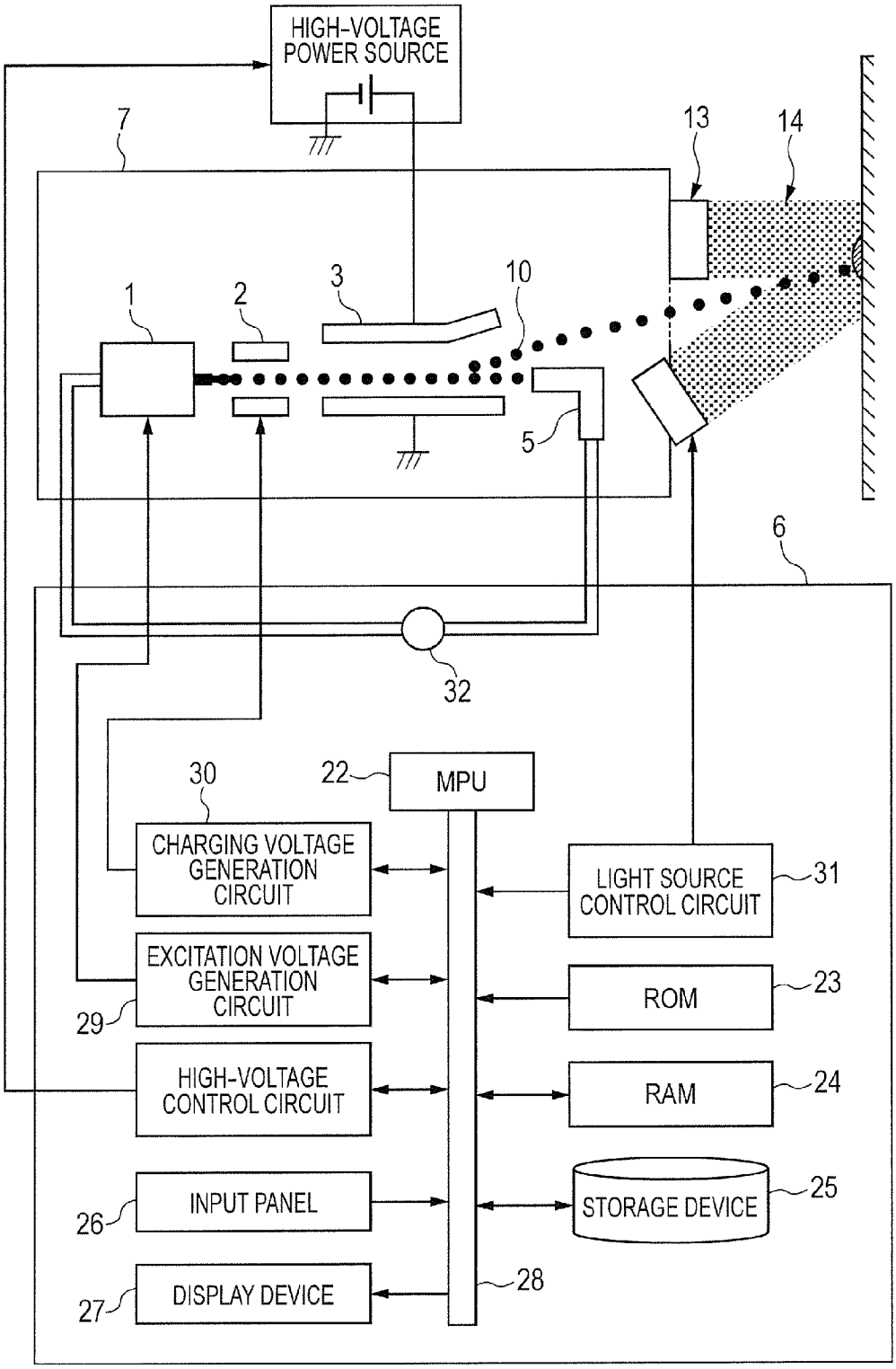
FIG. 8 is a block diagram showing the configuration of this embodiment.

FIG. 8 is a block diagram showing the configuration of this embodiment. First, the overview of the configuration of a control unit will be described. The reference numeral 22 denotes an MPU (microprocessing unit) which controls the entire ink jet recording apparatus. The reference numeral 23 denotes a ROM (read-only memory) which stores a control program and data necessary for operating the MPU. The reference numeral 24 denotes a RAM (rewritable memory) which temporarily stores data necessary during program execution. The reference numeral 25 denotes a storage device which stores a program and print data. The reference numeral 26 denotes an input panel which inputs the contents printed and a set value. The reference numeral 27 denotes a display device which displays inputted data and contents printed. The reference numeral 28 devotes a bus line which transmits a data signal, an address signal, and a control signal of the MPU. The reference numeral 29 denotes an excitation voltage generation circuit for generating a voltage for forming each ink particle from the ink. The reference numeral 30 denotes a charging voltage generation circuit for generating a voltage according to a character signal in the ink particle. The reference numeral 31 denotes a light source control circuit for electrically controlling the UV light emission mechanism in the present invention.

Next, the overview of printing and the configuration of an ink circulation unit will be described. The ink jetted from the nozzle 1 is formed into ink particles by the electrostriction element of the nozzle with the excitation voltage generated by the excitation voltage generation circuit 29. The voltage generated by the charging voltage generation circuit 30 is provided to the charging electrode 2, so that each of the ink particles is charged with the voltage according to the character signal. The charged ink particle flies in the electric field generated by the deflection electrode 3, is deflected according to the charging amount thereof, and reaches the printed substrate to form a character. The remaining ink particles not used for printing are collected by the gutter 5 for ink collection, and are then supplied to the nozzle 1 again by a pump 32.

Second Embodiment

Figure 9:
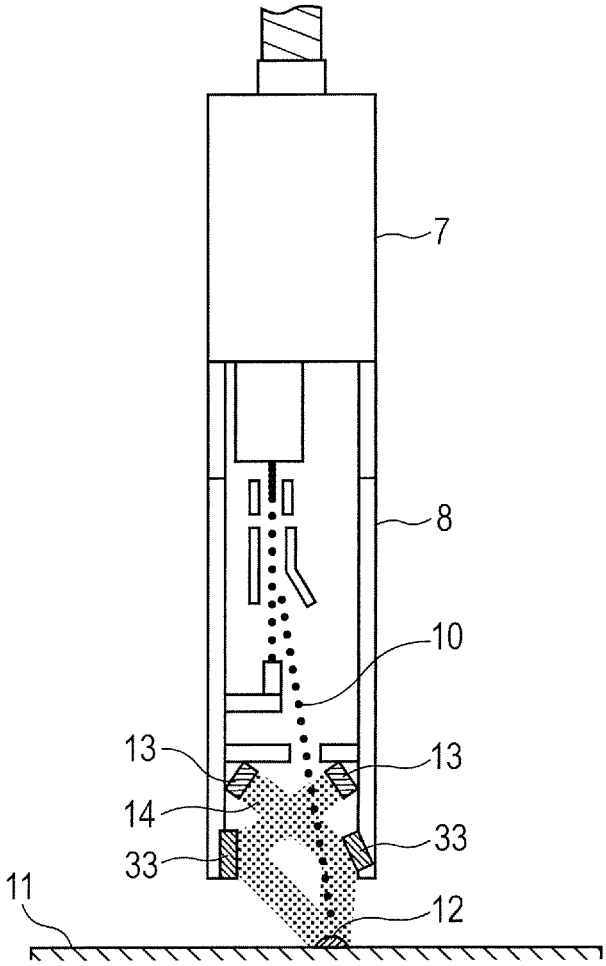
FIG. 9 is a sectional schematic diagram showing an example of the UV light source.

FIG. 9 shows another embodiment. The ink circulation mechanism of this embodiment and the components therefor can be the same as the first embodiment. In this embodiment, the end of the print head cover 8 is extended as compared with the first embodiment, and a reflection mirror 33 is provided on the printed substrate 11 side with respect to the UV light source 13. With this, the UV light can be emitted to each ink droplet passing between the UV light source and the reflection mirror more efficiently. The reflection mirror is not particularly limited as long as it reflects the UV light. In addition, in this example, the reflection mirror is provided in the head, but should be arranged in the position where the focused UV light can be emitted to the flying path 10 and the printing object 12. Further, the reflection mirror may have a concave reflection surface to focus the UV light onto the flying path and the printing object by itself.

What is claimed is:

1. A charge control type ink jet printer comprising:

a nozzle which continuously forms ink droplets;

a charging electrode which charges each of the ink droplets;

a deflection electrode which deflects a portion of the charged ink droplets;

a collection opening which collects a remaining portion of the ink droplets which are not deflected; and a print head which discharges the deflected ink droplets to print the droplets onto a printed substrate, wherein the print head has a UV light source, wherein the UV light source has a focusing member, which focuses UV light onto at least part of a flying path of the deflected ink droplets between the print head and the printed substrate and onto a landing region of the printed substrate, and a light emission source, wherein the UV light source emits UV light across the flying path, wherein the print head has a reflection plate on a printed substrate side with respect to the UV light source, and wherein the reflection plate reflects the UV light emitted by the UV light source toward the flying path.

2. The charge control type ink jet printer according to claim 1, wherein the focusing member has a lens.

3. The charge control type ink jet printer according to claim 2, wherein the focusing member has a focal point adjusting mechanism which adjusts a distance between the lens and the light emission source.

4. The charge control type ink jet printer according to claim 1, wherein the UV light source includes plural UV light sources.

5. The charge control type ink jet printer according to claim 4, wherein at least some of the UV light sources emit UV light differing in wavelength.

6. The charge control type ink jet printer according to claim 1, wherein the ink droplets contain a reactive monomer, a solvent, a coloring agent, and a photoreaction initiator, the photoreaction initiator having absorption with respect to a wavelength of the UV light source.

7. A printing method of a charge control type ink jet printer which continuously forms ink droplets, charges each of the ink droplets, deflects a portion of the charged ink droplets, and discharges the deflected ink droplets to print the droplets onto a printed substrate, wherein UV light is focused and emitted to at least part of a flying path of the discharged ink droplets and a landing region of the printed substrate, and wherein the focused UV light is emitted across the flying path, and is then reflected to be emitted to the flying path again.

8. The printing method according to claim 7, wherein a lens is used to focus the UV light.

9. The printing method according to claim 8, wherein a distance between the light source of the UV light and the lens is adjusted to focus the UV light.

10. The printing method according to claim 7, wherein the UV light is focused and emitted from plural light sources.

11. The printing method according to claim 10, wherein at least some of the light sources include UV light differing in wavelength.

* * * * *